United States Patent [19]

Stout

[11] Patent Number: 4,526,233

[45] Date of Patent: Jul. 2, 1985

[54] RELEASABLE COUPLING FOR TUBING CONVEYED SUBTERRANEAN WELL PERFORATING GUN

[75] Inventor: Gregg W. Stout, Montgomery, Tex.

[73] Assignee: Baker Oil Tools, Inc., Orange, Calif.

[21] Appl. No.: 572,437

[22] Filed: Jan. 20, 1984

[51] Int. Cl.[3] ..... E21B 23/04; E21B 43/116

[52] U.S. Cl. ..... 166/377; 166/55; 166/297; 166/383; 175/2; 175/4.56

[58] Field of Search ..... 166/377, 383, 63, 55.1, 166/117, 297; 285/18; 175/4.53, 2, 4.56, 4.5–4.56

[56] References Cited

U.S. PATENT DOCUMENTS

| | | | |
|---|---|---|---|
| 3,455,578 | 7/1969 | Hanes | 285/18 |
| 3,706,344 | 12/1972 | Vann | 166/55 |
| 3,842,914 | 10/1974 | Mott | 166/377 |
| 3,997,006 | 12/1976 | Wetzel | 166/377 |
| 4,040,482 | 8/1977 | Vann | 166/297 |
| 4,113,016 | 9/1978 | Trott | 175/4.56 |
| 4,299,287 | 11/1981 | Vann et al. | 166/55.1 |

*Primary Examiner*—Stephen J. Novosad
*Assistant Examiner*—Bruce M. Kisliuk
*Attorney, Agent, or Firm*—Norvell & Associates

[57] ABSTRACT

A method and apparatus for releasing a subterranean well perforating gun from a tubular string after firing of the subterranean well perforating gun. The apparatus comprises two telescopically inter-related tubular assemblies which are interconnected for axial co-movement solely by a plurality of radially shiftable latching elements. Such latching elements are normally maintained in a locked position by an annular piston. One end of the annular piston is exposed to gas at surface ambient pressure and the other end is exposed to the gas pressure generated in the perforating gun by its discharge and subsequently to the well fluid pressures produced by flow of well fluids through the perforations. The movement of the annular piston under such fluid pressure forces permits the locking elements to be cammed radially inwardly and release the connection between the tubular tool string and the perforating gun without any action on the part of the operator.

17 Claims, 4 Drawing Figures

RELEASABLE COUPLING FOR TUBING CONVEYED SUBTERRANEAN WELL PERFORATING GUN

BACKGROUND OF THE INVENTION

1. Description of the Prior Art

Perforating guns have long been employed to achieve the perforation of a well casing and an adjacent production formation. Originally, such perforating guns were lowered into the casing to the desired location on a wire line and then electrically activated to effect their discharge. More recently, perforating guns have been conveyed on the bottom of a tool string having an uninterrupted bore through which a detonating bar could be dropped to effect the firing of the gun, or in which a fluid pressure could be developed to effect a fluid pressure actuated detonation of a perforating gun. The tubing conveyed perforating gun has the advantage that other operations, such as chemical treatment, washing and/or gravel packing of the perforations and the production screen, can be accomplished with a single trip of the tool string into the well. See for example U.S. Pat. No. 3,987,854 (Callihan, et al).

It has been previously suggested in the prior art that production tubing be utilized as the tool string on which the perforating gun is inserted in the well. In such case, it often becomes desirable to disconnect the perforating gun after the perforating operation has been performed so that the subsequent movements of the tool string to effect the positioning of the screen adjacent to the perforations and to effect the chemical treatment, washing and/or gravel packing of the perforations may be conveniently accomplished without requiring the movement of the additional weight of the discharged perforating gun. It is therefore desirable to provide an economical, yet reliable apparatus for effecting the release of the perforating gun from the tool string.

The release of a tubing conveyed perforating gun has heretofore been disclosed in the prior art. See for example U.S. Pat. No. 3,706,344 (Vann) and U.S. Pat. No. 4,040,482 (Vann) and earlier references. Such prior art references, however, contemplate the severance of a perforating gun from the tool string by a tubing cutter or a wire line operated latch releasing mechanism. Obviously, the employment of a tubing cutter or any wire line disconnecting device necessitates the introduction of substantial delay due solely to the operation of separating the perforating gun from the tool string.

SUMMARY OF THE INVENTION

This invention provides a releasable coupling device for a perforating gun which is run into the well on a tubular work string or production string which may include one or more tools, such as packers, screens, washers, perforation treatment apparatus, gravel packers or the like. The releasable coupling comprises a first tubular assemblage which is threadably secured to the top of the housing containing the perforating gun. A second tubular assembly is threadably connected to the bottom of the tubular tool string. The two tubular assemblies have nestable sleeve portions which are normally held in secured relationship by a plurality of peripherally spaced, radially shiftable locking elements.

The locking elements are held in their securing position with respect to the two nested sleeves by a retaining sleeve which in turn forms part of an annular piston. The upper portion of the annular piston projects into an annular fluid pressure chamber maintained at surface ambient pressure. The lower portion of the annular piston projects into an annular fluid pressure chamber which is connected by fluid conduits to the interior of the perforating gun housing so that the high pressure blast of gas which is normally created within the perforating gun housing upon discharge of the perforating gun is directed into engagement with the lower end of the annular piston. This produces an upward movement of the piston sufficient to bring an annular recess into alignment with the radially shiftable locking elements which are then cammed into such recess by the inherent weight of the perforating gun suspended therefrom and moved radially inwardly to disconnect the nested sleeves, thus permitting the second tubular assembly and the tubular tool string to be moved upwardly relative to the perforating gun, or conversely, to permit the first tubular assembly and the discharged perforating gun to slide downwardly out of engagement with the tubular tool string to lodge in the bottom of the well.

It is thus assured that when the perforating gun is discharged, the releasable coupling will be automatically actuated to effect the disconnection of the two tubular assemblies due to the gas pressure force developed by the discharge. Such gas pressure force may be conveniently directed to the actuating piston by positioning the hammer and the explosive primer within the lower portion of the bore of the second tubular assembly and providing an annular communicating chamber between the explosive primer and the lower annular fluid pressure chamber. If, for any reason, the gas pressure developed by the discharge of the perforating gun is inadequate to effect the shifting of the actuating piston to effect the release of the coupling mechanism, the fluid pressure existing in the well at the location of the perforating gun will flow through the newly created openings in the gun housing and into the lower annular fluid pressure chamber to operate against the lower portion of the annular actuating piston and thus assure the release of the radially shiftable locking elements.

Accordingly, the disconnection of the tubing string conveyed perforating gun from the tool string occurs automatically immediately following the discharge of the perforating gun, thus eliminating the necessity for any wire line or other operations for effecting the disconnection of the perforating gun.

Further objects and advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1A:
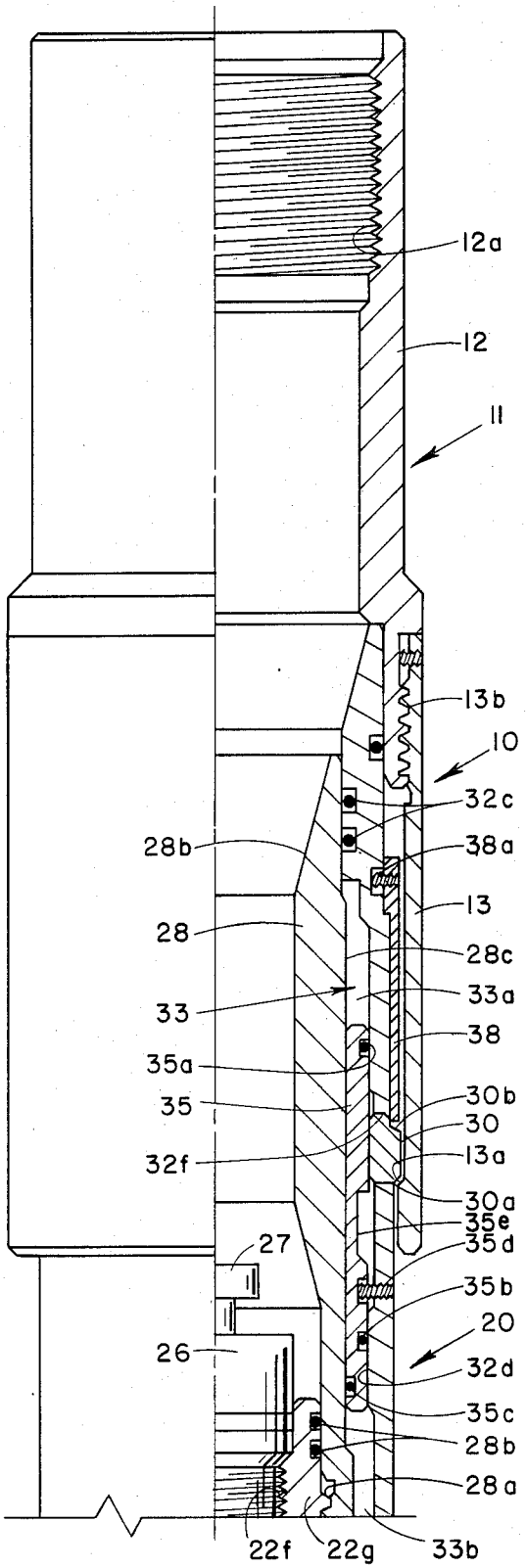
FIGS. 1A and 1B collectively constitute a vertical quarter-sectional view of a perforating gun coupling mechanism embodying this invention, with components thereof shown in the coupled or connected position.
Figure 1B:
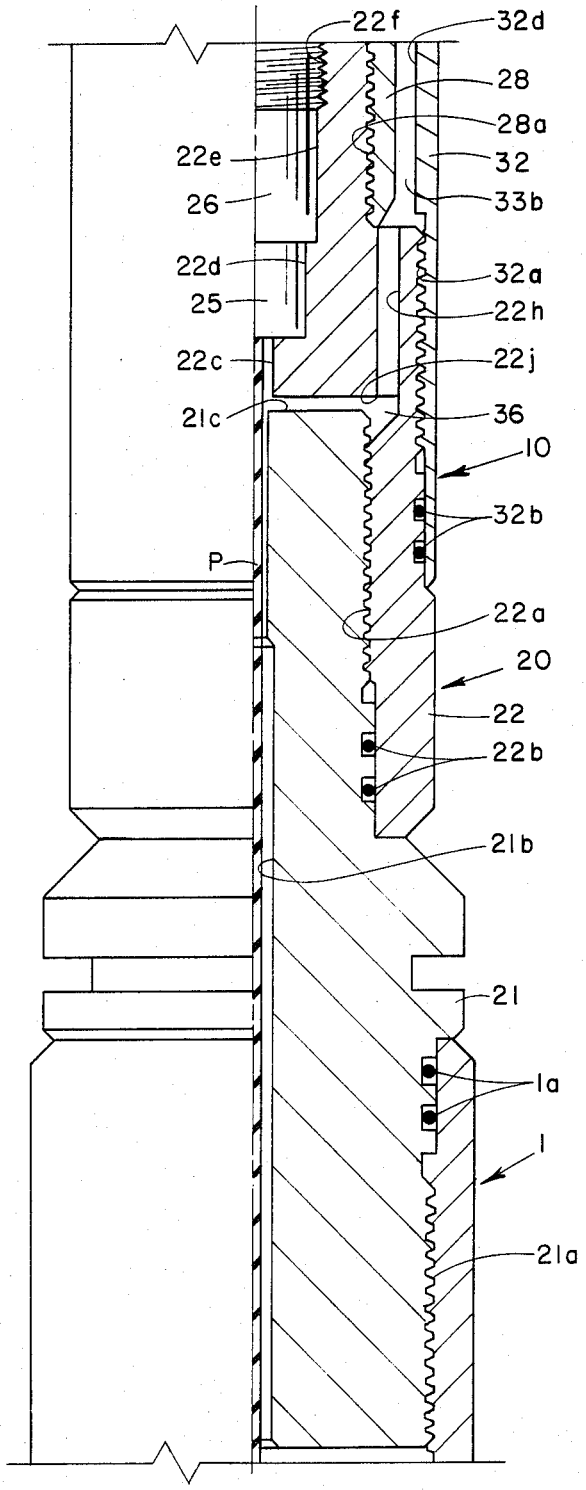

Turning to FIGS. 1A and 1B, there is shown a releasable coupling mechanism 10 embodying this invention. Such mechanism comprises an upper tubular assembly 11 having internal threads 12*a* for sealably connecting to the bottom end of a tubular tool string. Such tool string may include a packer and one or more other well treatment or well completion devices, such as a screen, perforation washer, perforation treatment apparatus, and/or a gravel packing apparatus.

Releasable coupling 10 further comprises a lower tubular assembly 20 which terminates in external threads 21*a* to which may be sealably secured the housing 1 of a conventional perforating gun. The two tubular assemblies 11 and 20 are normally interconnected by a plurality of peripherally spaced, radially shiftable latching lugs 30. In the connected position shown in FIG. 1A, the latching lugs 30 are shown in their radially outermost position wherein downwardly facing, inclined shoulders 30*a* on the lugs 30 are in abutting engagement with an upwardly facing inclined shoulder 13*a* provided on the bottom portion of a latching sleeve 13 which is threadably secured at its upper end by threads 13*b* to the bottom end of a sub 12 which forms the other component of the upper tubular assembly 11.

Starting from the bottom and proceeding upwardly, the lower tubular assembly 20 comprises a connecting nipple 21 which is externally threaded at 21*a* for sealably mounting thereto the housing 1 of a conventional perforating gun. O-rings 1*a* seal the threads 21*a*. A typical gun which may be employed is that shown in co-pending application, Ser. No. 366,267, filed May 7, 1982. Nipple 21 has a constricted axial bore 21*b* which is normally traversed by a length of Primacord P which transmits energy from a detonatable primer 25 contained in the upper portion of the lower tubular assembly 20 down to the plurality of horizontally and vertically spaced shaped charges (not shown) that are conventionally provided in the perforating gun housing 1.

An inner body sleeve 22 is secured by internal threads 22*a* to the top portion of nipple 21 and the threaded joint is sealed by O-rings 22*b*. Inner body sleeve 22 is contoured to surround the upper end of nipple 21 and is provided with an axial bore 22*c* extending therethrough. The bore 22*c* is counterbored at 22*d* to provide an open bottom chamber for mounting of primer 25. A second counterbore 22*e* is provided above counterbore 22*d* to mount a conventional firing head 26 by threads 22*f*. Firing head 26 includes a conventional hammer 27 which is mounted for axial movement upon receipt of a downwardly directed impact blow. Any such blow imparted to hammer 27 detonates the primer 25 and in turn ignites the Primacord P.

Since there is an unobstructed axial passage from the location of the firing head 26 up through the bore of the upper tubular assembly 12, those skilled in the art will recognize that any type of firing mechanism, such as an electrically actuated mechanism, could be employed merely by connecting an appropriate electric wire line to the firing head 26, with the electric wire line passing through the unobstructed bore of the coupling 10 and through the tubing string to the surface of the well. Preferably, however, a conventional detonating bar (not shown) is dropped through the bore of the connected tool string to impact upon hammer 27 to effect the ignition of primer 26 and the subsequent ignition of the charges in the perforating gun. To aid in the direction of the detonating bar, an axially upwardly extending guide sleeve 28 is provided which is threadably secured at its lower end by threads 28*a* to a nipple portion 22*g* of the inner body sleeve 22. O-rings 28*b* seal the threaded connection 28*a*. Guide sleeve 28 has an internal bore 28*b* contoured to direct the detonating bar to centrally impact on hammer 27.

An outer body sleeve 32 is threadably secured by internal threads 32*a* to the lower portions of the inner body sleeve 22. Threads 32*a* are of larger diameter than threads 28*a*. The outer body sleeve 32 extends upwardly beyond the upper end of the guide sleeve 28 where it projects inwardly and is sealingly engaged with such upper end by O-rings 32*c*. The annular space 33 between the inner body sleeve 22 and the outer body sleeve 32 is divided into an upper portion 33*a* constituting a closed fluid pressure chamber, and a lower portion 33*b* constituting an open bottom fluid pressure chamber, by an annular piston 35 which is sealably engaged with the inner wall 32*d* of the outer body sleeve 32 by O-rings 35*a* and 35*b*, and with the upper end of the exterior cylindrical wall 28*c* of the guide sleeve 28 and is sealingly engaged with such upper end by O-ring 32*c*. It will therefore be apparent that the upper annular fluid pressure chamber 33*a* is maintained at the surface ambient pressure as the tool string is inserted into the well. Fluid pressure chamber 33*a* is preferably filled with air or an inert gas so that upward movement of the piston 35 can occur, provided a suitable pressure differential exists across the upper and lower surfaces of piston 35.

The lower annular fluid pressure chamber 33*b* is in fluid communication with a plurality of peripherally spaced vertical fluid passages 22*h* which are formed in the inner body sleeve 22. These passages in turn communicate with an annular chamber 36 defined between a radial wall 22*j* formed on the inner body member 22 and the extreme upper end face 21*c* of the nipple 21. The lower annular pressure chamber 33*b* is therefore in fluid communication with the restricted bore 21*b* containing the Primacord P and hence is in fluid communication with the interior of the perforating gun housing 1 and thus will receive the high pressure gases generated within such housing as a result of the discharge of the shaped charges contained in the perforating gun housing.

Figure 2:
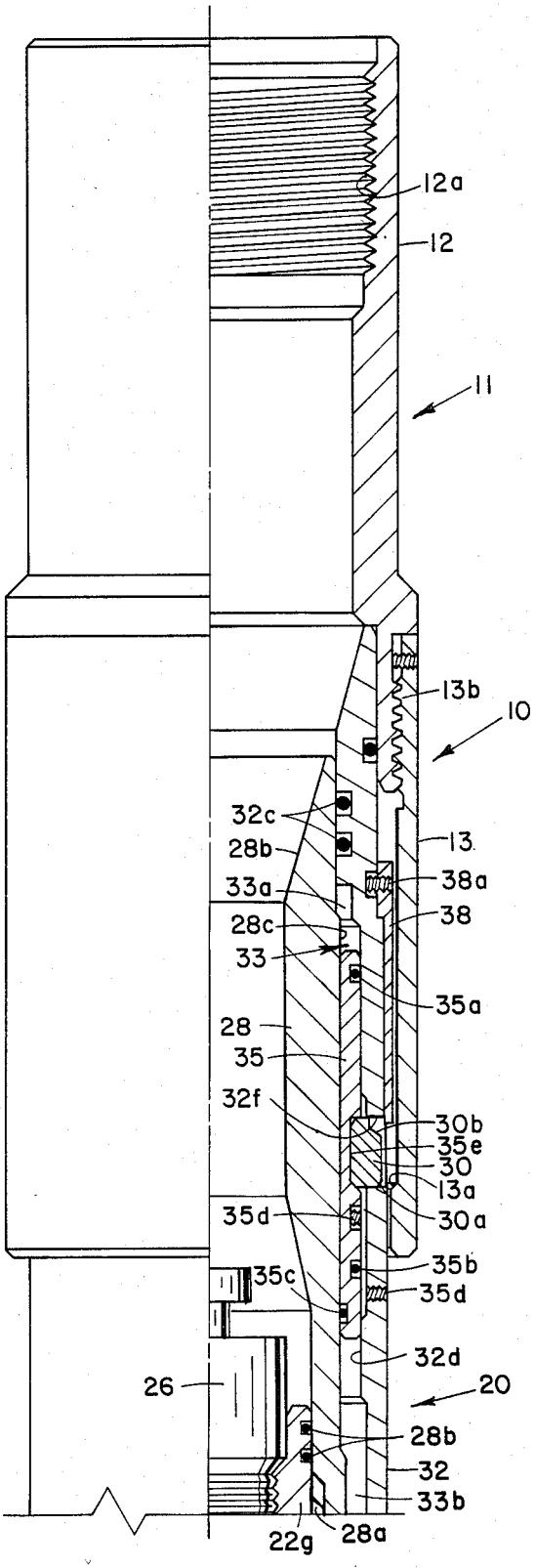
FIG. 2 is a view similar to FIG. 1A but showing the shifting of the actuating piston to a position permitting the latching elements to shift radially inwardly to release the two components of the coupling mechanism.

As shown in FIG. 1A, the outer surface 35*d* of the annular piston 35 is in abutting relationship with the interior surfaces of the latching lug elements 30 and hence maintains a coupling or connection between the upper tubular assembly 11 and the lower tubular assembly 20 so long as the piston 35 remains in the illustrated position. Whenever a fluid pressure differential is built up across the top and bottom ends of the annular piston 35, and in particular, a higher fluid pressure is exerted on the bottom end of the annular piston 35 than on the top end, the piston 35 will be shifted upwardly, compressing the ambient pressure compressible gas contained in the upper enclosed annular fluid pressure chamber 33*a*. Such upward movement of piston 35 will bring an annular recess 35*e* on its periphery into alignment with the peripherally spaced latching elements 30, thus permitting such latching elements to be cammed inwardly by cooperating inclined surfaces 30*a* and 13*a* to release the latching engagement between the cooperating latching surfaces 30*a* and 13*a*, as illustrated in FIG. 2. Since the latching lugs 30 constitute the only physical connection between the upper tubular assembly 11 and the lower tubular assembly 20, the coupling 10 is effectively disconnected and the perforating gun may be axially separated from the tubular work string as illustrated in FIG. 3.

Latching lugs 30 are mounted in peripherally spaced slots 32*f* provided in outer body sleeve 32. In order to prevent the latching lugs 30 from falling into the well bore when released from the latching sleeve 13, a locking lug holding sleeve 38 is provided which is secured to the upper external portion of the internal body sleeve 22 by a plurality of radially disposed bolts 38*a*. Retaining sleeve 38 extends downwardly and overlies a notch 30*b* provided in each of the locking elements 30, thus preventing such locking elements from falling out of the assemblage when the tubular assemblages are separated, as illustrated in FIG. 3. Additionally, in order to prevent the premature movement of the piston 35, a plurality of shear pins 35*d* are mounted between the piston 35 and the upper body sleeve 32 to maintain the piston in the coupled position illustrated in FIG. 1 until sufficient fluid pressure force is exerted on the piston to shear the shear pins 35*d* and permit piston 35 to move upwardly.

In the event that the perforating gun does not generate sufficient fluid pressure force to cause the piston 35 to shear the shear pins 35*d* and move upwardly to release the radially shiftable locking lugs 30, it will be apparent that the lower annular fluid pressure chamber 33*b* will be promptly filled with well fluids resulting from flow through the perforations and into the interior of the perforating gun housing. Such well fluid pressures are normally substantially in excess of the surface ambient pressure existing in the upper annular fluid pressure chamber 33*a*, and hence will exert an upward force on the piston 35 to effect the shearing of the shear pins 35*d* and the movement of piston 35 to the latching lug releasing position illustrated in FIG. 2.

Figure 3:
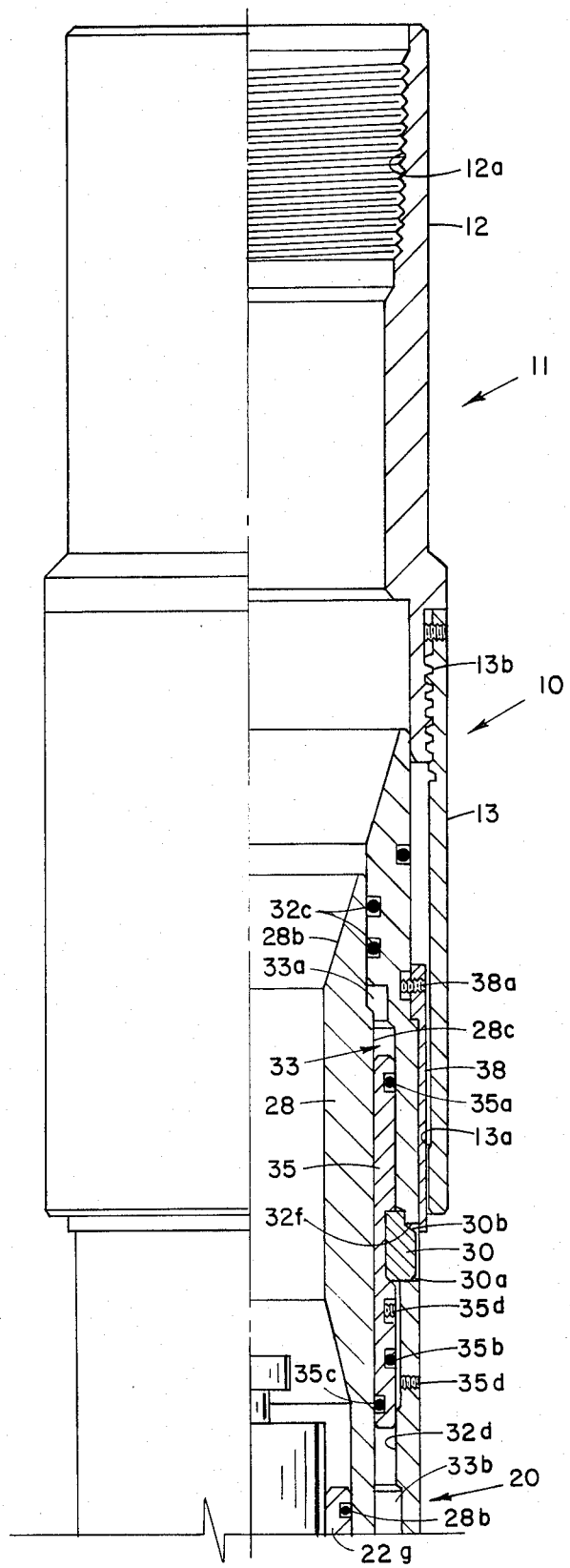
FIG. 3 is a vertical quarter-sectional view showing the axial separation of the two disconnected components of the coupling mechanism.

Accordingly, if firing of any portion of the charges contained in the perforating gun is accomplished, it will be readily apparent to those skilled in the art that the annular piston 35 will be actuated to release the radially shiftable locking lugs and effect the disconnection of the upper tubular assembly 11 and the lower tubular assembly 20, thus disconnecting the perforating gun from the tubular tool string as illustrated in FIG. 3. Such action is automatic and requires no time or effort on the part of the operator, thus permitting the completion of the well to be accomplished more rapidly.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A releasable coupling for connecting a subterranean well perforating gun to a tubular tool string, said perforating gun being of the type including a hollow housing that receives a charge of pressured gas following discharge of the perforating gun, comprising, in combination: a first tubular assembly having means on its lower end for threadably connecting with said hollow housing; a second tubular assembly having means on its upper end for threadably connecting with the tubular tool string; the lower end of said second tubular assembly being disposed in concentric, overlapping relation to the upper end of said first tubular assembly; radially shiftable latching means normally interconnecting said overlapped portions of said first and second tubular assemblies, thereby securing the perforating gun to the tubular tool string; axially shiftable piston means operatively connected in one position to said radially shiftable latching means to hold same in said normal interconnecting position; and conduit means for supplying pressured fluid from said hollow housing to said piston means to axially shift same out of said one position, thereby permitting said radially shiftable latching means to disconnect said first and second tubular assemblies.

2. A releasable coupling for connecting a subterranean well perforating gun to a tubular tool string, said perforating gun being of the type including a hollow housing that receives a charge of pressured gas following discharge of the perforating gun, comprising, in combination: a first tubular assembly having means on its lower end for threadably connecting with said hollow housing; a second tubular assembly having means on its upper end for threadably connecting with the tubular tool string; the lower end of said second tubular assembly being disposed in concentric, overlapping relation to the upper end of said first tubular assembly; radially shiftable latching means normally interconnecting said overlapped portions of said first and second tubular assemblies, thereby securing the perforating gun to the tubular tool string; means on said first tubular assembly defining an annular fluid pressure chamber; an annular piston mounted in said annular fluid pressure chamber for axial movement between a first position preventing radial movement of said radially shiftable, latching means to an unlatched position and a second position permitting radial movement of said radially shiftable latching means to said unlatched position; and conduit means in said first tubular assembly for conducting pressured fluid resulting from the firing of the perforating gun to said annular fluid pressure chamber.

3. The apparatus of claim 2 wherein said first tubular assembly defines an open bottom chamber; detonating means disposed in said chamber; said conduit means comprising an annular chamber communicating with said open bottom chamber.

4. The apparatus of claim 3 wherein said first tubular assembly defines an open bottom chamber communicating with the interior of the perforating gun hollow housing; a detonatable primer disposed in said chamber; means in the bore of said first tubular body for detonating said primer; and said conduit means comprises an annular chamber communicating with said open bottom chamber.

5. The apparatus of claim 4 wherein said means for detonating said primer comprises a hammer axially slidably mounted in said second tubular body; said hammer being positioned in the bore of said first tubular assembly to be impacted by the dropping of a detonating bar through said tubular tool string.

6. The apparatus of claim 1 wherein said first tubular assembly defines an open bottom chamber, the upper end of said piston being slidably and sealably mounted in said open bottom annular fluid pressure chamber to trap compressible gas above said piston at surface ambient pressure, said conduit means connecting the open bottom of said annular fluid pressure chamber to said hollow housing, whereby said piston also is shiftable in response to well fluids entering said hollow housing after discharge of the perforating gun.

7. The apparatus of claim 1 wherein said first tubular assembly comprises an inner tubular body, an outer tubular body sealingly secured to said inner tubular body and defining an open bottom annular fluid pressure chamber therebetween; and said piston means comprises an annular piston, the upper end of said piston being slidably and sealably mounted in said open bottom annular fluid pressure chamber to trap a compressible gas above said piston at surface ambient pressure, and said conduit means connects the open bottom of said annular fluid pressure chamber to said hollow housing, whereby said annular piston is also shiftable in response to downhole well fluids entering said hollow housing after discharge of the perforating gun.

8. The apparatus of claim 1 wherein said radially shiftable latching means comprises a plurality of elements respectively mounted in a plurality of peripherally spaced slots formed in said first tubular assembly; and a retaining sleeve secured to the exterior of said first tubular assembly and having an end portion overlapping a portion of said slots, thereby limiting radially outward movement of said elements to retain same on said first tubular assembly after separation of said first and second tubular assemblies.

9. The apparatus of claim 2 wherein said radially shiftable latching means comprises a plurality of lugs respectively mounted in a plurality of peripherally spaced slots formed in said first tubular assembly and a retaining sleeve secured to the exterior of said first tubular assembly and having an end portion overlapping a portion of said slots, thereby limiting radially outward movement of said lugs to retain same on said first tubular assembly after separation of said first and second tubular assemblies.

10. The apparatus of claim 4 further characterized by a primer cord disposed between said detonatable primer and the interior of the perforating gun hollow housing.

11. The apparatus of claim 2 wherein said annular fluid pressure chamber is defined between an inner tubular body having two axially adjacent external threaded portions of different diameters, an outer sleeve secured at one end to the largest diameter threaded portion and having a bore defining the outer wall of said annular fluid pressure chamber; an inner sleeve secured at one end to the small diameter threaded portion and having a cylindrical exterior surface defining the inner wall of said annular fluid pressure chamber; and means for sealingly joining the other ends of said inner and outer sleeves, whereby a compressible gas at surface pressure may be trapped in said annular fluid pressure chamber by said annular piston.

12. Apparatus for uncoupling a subterranean well perforating gun of the type having a hollow housing receiving explosive generated gases and well fluid subsequent to firing the perforating gun, comprising a coupling apparatus having two nested parts normally secured together for axial co-movement; fluid pressure responsive means for disconnecting said nested parts to permit axial separation thereof; and conduit means for supplying fluid pressures from the hollow housing to said fluid pressure responsive means.

13. The apparatus of claim 12 wherein said fluid pressure responsive means includes an axially shiftable annular piston; one side of said annular piston being exposed to the fluid pressures generated in the hollow housing.

14. The apparatus of claim 13 further comprising means for applying a gas at a pre-determinable pressure to the other side of said annular piston.

15. The method of uncoupling a subterranean well perforating gun from a tubular tool string comprising the steps of:

1. connecting a perforating gun, of the type having a hollow housing that is filled with pressured gas and well fluids after the gun is fired, to a tubular tool string by a tubular coupling assembly having two nested parts secured against axial separation by a radially shiftable locking element;
2. positioning an annular piston adjacent the radially shiftable locking element to prevent radial movement of the locking element in the direction to release the nested parts for axial separation; and
3. providing fluid communication between the interior of the perforating gun housing and one side of said piston, whereby said piston is shifted in a direction to permit radial movement of the locking element to disconnect the nested parts by fluid pressure generated in the hollow housing subsequent to firing the perforating gun.

16. The method of claim 15 further comprising the step of exposing the other side of the piston to a confined gas at surface ambient pressure.

17. The method of uncoupling a well perforating gun from a tubular tool string comprising the steps of:

1. disposing the charges of the perforating gun in a hollow housing;
2. connecting the hollow housing to the tubular tool string by a fluid pressure responsive uncoupling apparatus; and
3. supplying fluid pressures developed in the hollow housing by firing of the charges to the fluid pressure responsive uncoupling apparatus.

* * * * *